US005944101A

United States Patent [19]

Hearn

[11] Patent Number: 5,944,101

[45] Date of Patent: Aug. 31, 1999

[54] APPARATUS FOR MILLING A WINDOW IN WELL TUBULAR

[75] Inventor: David D. Hearn, Anchorage, Ak.

[73] Assignee: Atlantic Richfield Company, Los Angeles, Calif.

[21] Appl. No.: 09/094,879

[22] Filed: Jun. 15, 1998

[51] Int. Cl.[6] ..... E21B 29/06

[52] U.S. Cl. ..... 166/117.5; 166/55.7

[58] Field of Search ..... 166/117.6, 55.7, 166/298, 117.5, 55.6; 175/81

[56] References Cited

U.S. PATENT DOCUMENTS

| | | | |
|---|---|---|---|
| 4,397,360 | 8/1983 | Schmidt . | |
| 5,222,554 | 6/1993 | Blount et al. . | |
| 5,277,251 | 1/1994 | Blount et al. . | |
| 5,287,921 | 2/1994 | Blount et al. . | |
| 5,346,017 | 9/1994 | Blount et al. | 166/380 |
| 5,458,209 | 10/1995 | Hayes et al. | 175/61 |
| 5,551,509 | 9/1996 | Braddick | 166/55.7 |
| 5,727,629 | 3/1998 | Blizzard, Jr. et al. | 166/298 |
| 5,787,978 | 8/1998 | Carter et al. | 166/117.6 |
| 5,803,176 | 9/1998 | Blizzard, Jr. et al. | 166/298 |

*Primary Examiner*—William Neuder
*Assistant Examiner*—Zakiya Walker
*Attorney, Agent, or Firm*—Drude Faulconer

[57] ABSTRACT

An apparatus for milling a window in a well tubular, e.g. a well casing, which is comprised of a whipstock and a cooperating mill. The mill has a nose portion depending from the bottom thereof and has cutting surfaces on both the bottom and the sides. The whipstock is comprised of a body which, in turn, has a tapered surface along at least a portion of its length. A guide, e.g. cylindrical pipe, is mounted on and is spaced from the tapered surface and is adapted to receive the nose portion on the mill to provide a guide path for the mill as it cuts or mills a window in the well casing. The guide is positioned so as to direct the side cutting surface of the mill into contact with the casing without contacting the tapered surface of the whipstock.

13 Claims, 3 Drawing Sheets

APPARATUS FOR MILLING A WINDOW IN WELL TUBULAR

TECHNICAL FIELD

The present invention relates to an apparatus for forming a window in a well tubular and in one of its aspects relates to an apparatus comprising a whipstock which, in turn, has a guide spaced from the tapered surface thereof to guide a mill into cutting contact with the inner wall of a well tubular, e.g. a well casing, while preventing the mill from engaging and damaging the surface of the whipstock.

BACKGROUND ART

Most wells of the type used in producing fluids (e.g. hydrocarbons) from subterranean formations are completed by cementing a string of well casing within the wellbore. The casing is then perforated adjacent the formation(s) of interest so that fluids can be injected/produced therethrough. As is well known in the art, there may be times when it becomes necessary to remove a section of this casing (i.e. cut or mill a "window" through the casing and cement) in order to carry out a required or desired operation.

For example, it is common to mill a window(s) in a well tubular (e.g. well casing) in order to drill a curved or inclined "drain hole(s)" outward from the cased wellbore into a formation of interest. The drain hole, which aids in producing fluids from the formation, may consist of a horizontal wellbore which is drilled outward from a substantially vertical, cased wellbore or, as will be understood in this art, it may be a wellbore which extends upward/downward or otherwise radially outward from a substantially horizontal or inclined, cased wellbore. In addition to the drilling of drain holes, there are also several other operations which might require the "cutting of a window(s)" in a well casing, e.g. sidetracking, all of which are well known to those skilled in the art.

There are several types of tools which have been developed for milling windows in well tubulars. For example, where a conventional drilling rig is used, a deflecting tool, commonly called a "whipstock" is lowered into the well casing and is supported at the desired depth by a concrete plug, an expanding anchor, or the like. The whipstock is properly oriented to insure that the window will be milled in the appropriate direction through the casing. A starting mill on the lower end of a rotating drill string is then lowered into engagement with the whipstock which, in turn, deflects the mill into contact with the casing to thereby mill a relatively short pilot hole in the casing. The drill string is retracted and the starting mill is replaced with a window mill or other speciality mill to complete the window-cutting operation. For a further description of this type of window-cutting operation, see U.S. Pat. No. 4,397,360, issued Aug. 9, 1983 and also, the prior art processes disclosed and fully discussed in both U.S. Pat. Nos. 5,277,251 and 5,287,921, Due to the expense normally associated with conventional drilling rigs, there has recently been a trend towards using commercially-available "coiled tubing units" for the milling of windows and other related operations whenever and wherever practical; see U.S. Pat. Nos. 5,277,251 and 5,287,921. As will be understood in the art, a typical coiled tubing unit is basically comprised of a continuous length of tubing which is wound on a large diameter drum and which can be fed into and out of a wellbore without having to "make up" or "break out" individual joints of the tubing.

If rotation is needed for a particular operation, a downhole motor is connected onto the lower end of the coiled tubing string to drive the mill. Further, since most coiled tubing strings and related tools are designed to be run and operated through a string of well tubing (e.g. such as the production tubing normally present in a cased well), there is no need to remove and replace the tubing from a well when carrying out a desired operation with a coiled tubing unit. This feature alone can amount to substantial savings in both time and expense in most operations.

In cutting a window in the well casing, either with conventional drilling rigs or with coiled tubing units, it is important that the cutting or milling surfaces of the mill be directed into contact with the casing without any substantial contact with the whipstock, itself. That is, the rotation of the mill has a tendency to draw the cutting surface of the mill into the first surface it contacts. It follows that if the mill contacts the casing first, the continued rotation of the mill will cause the mill to pull itself into the casing thereby cutting the desired window therein. However, if the cutting surfaces of the mill contacts the inclined or tapered surface of the whipstock first, then continued rotation will cause the mill to "dig in" into and cut the whipstock instead of the casing, thereby adversely affecting the window cutting operation.

In typical prior art operations, a tapered, non-cutting surface on the pilot or starting mill cooperates with a wear pad or the like on the whipstock to direct the cutting surfaces of pilot mill into contact with the casing while preventing the cutting surfaces from contacting the whipstock. While successful, only a very short pilot hole is normally cut into the casing before the non-cutting surface of the starting mill contacts the casing thereby interferring with any further cutting of the window. This requires "tripping" the drill string to replace the starting mill with a window mill or the like in order to provide a window having an adequate length to allow the subsequent operation to be carried out. Accordingly, a need exists for improved whipstocks and mills which can initiate and mill a window of substantial length with a miminum of manipulated steps by insuring that the cutting surfaces of the mill will contact the casing rather than the tapered surface of the whipstock.

DISCLOSURE OF THE INVENTION

The present invention provides apparatus for use in milling a window in a well tubular, e.g. a casing in a cased, subterranean well. The apparatus is comprised of a whipstock and a cooperating mill. The mill has a nose portion depending from the bottom thereof and has cutting surfaces on both its bottom and its sides. The whipstock is comprised of an elongated body which, in turn, has a tapered surface along at least a portion of its length. A guide is mounted on and is spaced from the tapered surface and is adapted to receive the nose portion on the mill to guide the the mill into the casing and away from the tapered surface of the whipstock as the side surface of the mill cuts or mills a window in the well casing.

More specifically, the whipstock of the present invention is run into a cased well on a workstring or the like and is positioned within the casing and is supported therein at a desired depth by any well known means; e.g. packer/anchor, expandable legs, etc. The whipstock is comprised of an elongated body which is substantially cylindrical at its lower portion and tapered along at least a portion of its length towards its upper end. An elongated guide (e.g. a length of conduit such as metal pipe) is spaced from and is mounted to the tapered portion of the whipstock by one or more supports. Preferably, the cylindrical guide is substantially parallel to the tapered surface of the whipstock and has its upper end of guide flared to provide a funnel-like entrance.

The mill has a pilot or nose portion extending from its bottom end and has cutting surfaces both on its bottom and sides. As the mill is lowered within the wellbore, the nose portion on the mill is directed into the guide by the flared, upper end thereof. The cooperation between the nose portion and the guide directs or forces the mill into contact with the casing while preventing the mill from contacting the tapered surface of the whipstock. As the side cutting surface of the mill cuts a window in the casing, the cutting surface on the bottom thereof will mill away the guide, itself.

Embodiments of the present whipstock can be used with either conventional drilling rigs or with coiled tubing units. When used with coiled tubing units, the whipstock and the mill are sized to be run and operated through well tubing which is normally present within most cased wellbores.

BRIEF DESCRIPTION OF THE DRAWINGS

The actual construction, operation, and apparent advantages of the present invention will be better understood by referring to the drawings in which like numerals identify like parts and in which.

BEST KNOWN MODE FOR CARRYING OUT THE INVENTION

Figure 1:
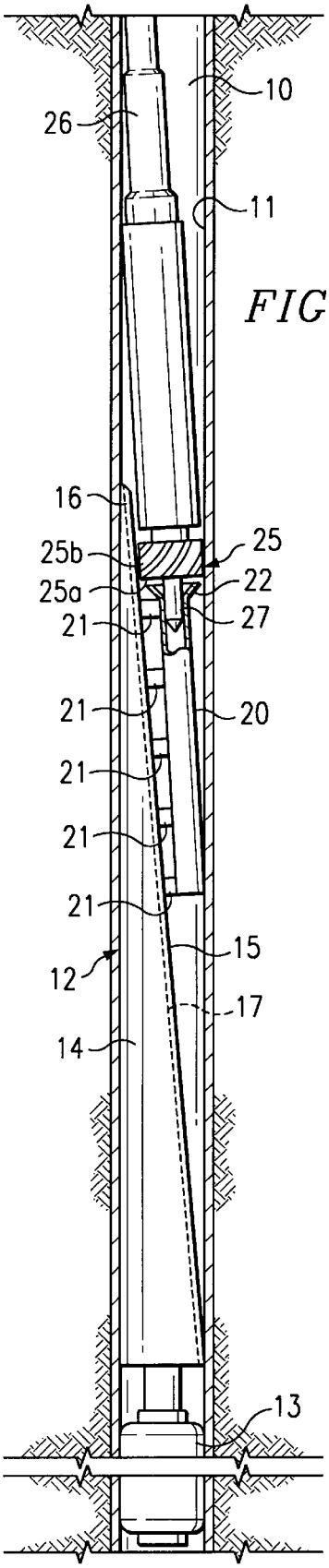
FIG. 1 is an elevational view, partly in section, of a whipstock and mill to be used with conventional drilling rigs in accordance with the present invention in an initial position within a cased wellbore.

Referring more particularly to the drawings, FIG. 1 illustrates a portion of a wellbore 10 which has been drilled and cased with casing 11. As will be understood, although not shown, casing 11 is cemented in place within the wellbore. While the present invention will be discribed in relation to a vertical wellbore, it should be understood that the invention is equally applicable for use in horizontal or inclined wellbores and accordingly, the terms "top and bottom" and "upper and lower", as used herein, are relative in nature when referring to respective positions within a wellbore.

Whipstock 12 is run in on a workstring (not shown) or the like and is positioned within casing 11 at a desired depth where it is supported by any well known means; e.g. packer/anchor 13. The basic construction of whipstock 12 is similar to that of many prior art, conventional whipstocks in that it is comprised of an elongated body 14 which is substantially cylindrical at its lower portion and is inclined or tapered along a portion 15 (i.e. tapered portion 15) of its length towards its upper end 16. The surface of tapered portion 15 may be somewhat concaved as represented by the dotted lines 17 (i.e. concaved surface 17) in FIG. 1.

In accordance with the present invention, a guide 20 is spaced from and is mounted to tapered portion 15. As shown, guide 20 is an elongated member which lies substantially parallel to the tapered portion 15 and is preferably a length of substantially cylindrical conduit (i.e. metal pipe) which is attached to and is spaced from tapered portion 15 by one or more supports 21. Preferably, the upper end of guide 20 is flared to form a funnel-like entrance 22 or the like at its upper end.

Mill 25 is mounted onto the lower end of drill string 26 and has a pilot or nose portion 27 extending from the bottom thereof. Mill 25 has cutting surfaces both on its bottom 25*a* and side 25*b* and is similar in construction to those commerically-available mills known as "pipe" mills. As drill string 26 is lowered into casing 11, nose portion 27 of the mill 25 engages funnel 22 which, in turn, directs the nose portion 27 into guide 20. The cooperation between nose portion 27 and guide 20 provides a guide path for the mill by directing the mill 25 into contact with casing 11 while preventing the mill from contacting concaved surface 17 on whipstock 12.

As will be understood by those skilled in this art, whipstock 12 is properly oriented when set onto packer/anchor 13 to provide for the milling a window in the desired direction. Orientation of the whipstock may be carried out utilizing conventional and well known methods, e.g. see U.S. Pat. No. 5,287,921, which is incorporated herein by reference.

Figure 2:
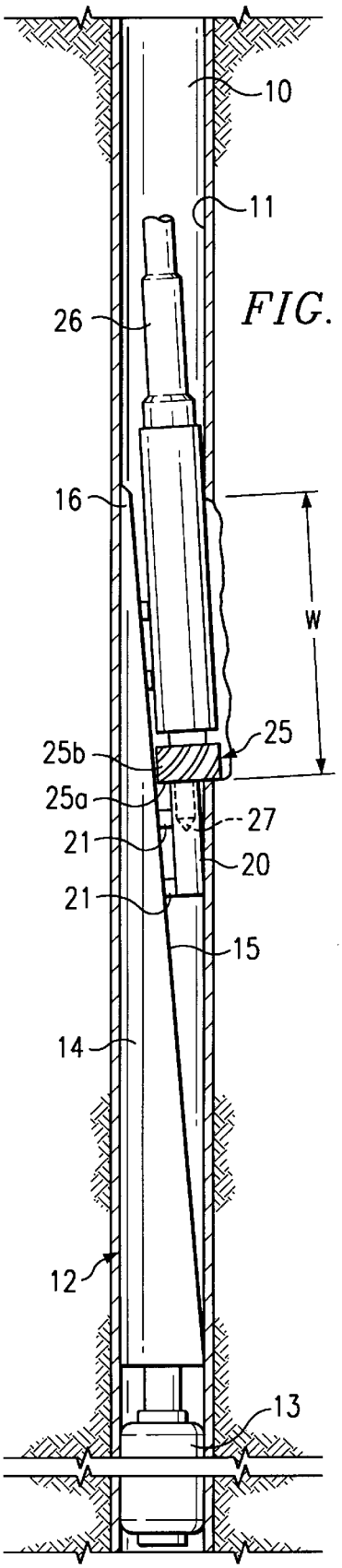
FIG. 2 is an elevational view, partly in section, of the whipstock of FIG. 1 after the mill has begun to cut a window in the well casing.

As mill 25 is rotated by drill string 26, the cutting surfaces on the side 25*b* of the mill will begin to cut a window W (FIG. 2) in casing 11 while the cutting surface on the bottom 25*a* will mill away the guide 20, itself, along with each support 21 as a support is reached by the mill. By forcing and maintaining the mill into cutting contact with the casing and away from inclined or tapered portion surface 15 of whipstock 12, a longer window W can be cut with the initial mill (i.e. starting mill) and will allow subsequent mills and/or drills to enter into the formation behind window W without having to mill a susbstantial amount of additional casing.

Figure 3A:
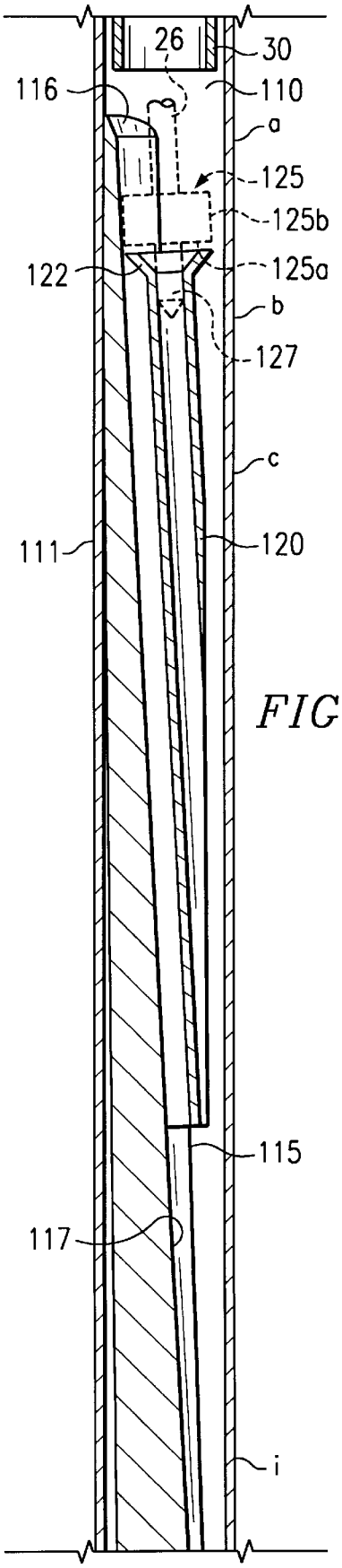
FIG. 3A is an elevational view of the upper portion of another embodiment of the whipstock to be used with coiled tubing units in accordance with the present invention in its initial position within a cased wellbore.
Figure 3B:
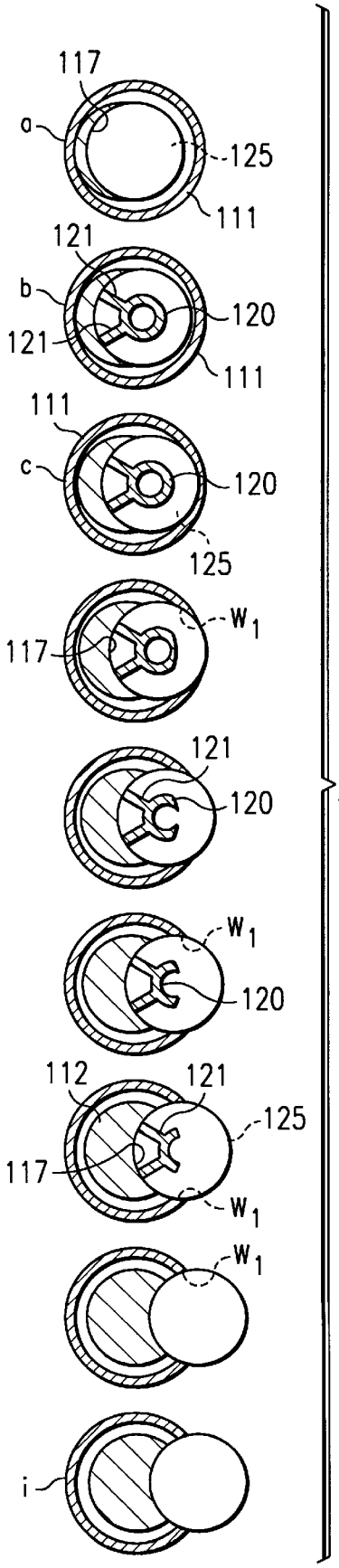
FIG. 3B is several related cross-sectional views which correspond to respective levels (only a few numbered for brevity) of the whipstock and wellbore of FIG. 3A.
Figure 4A:
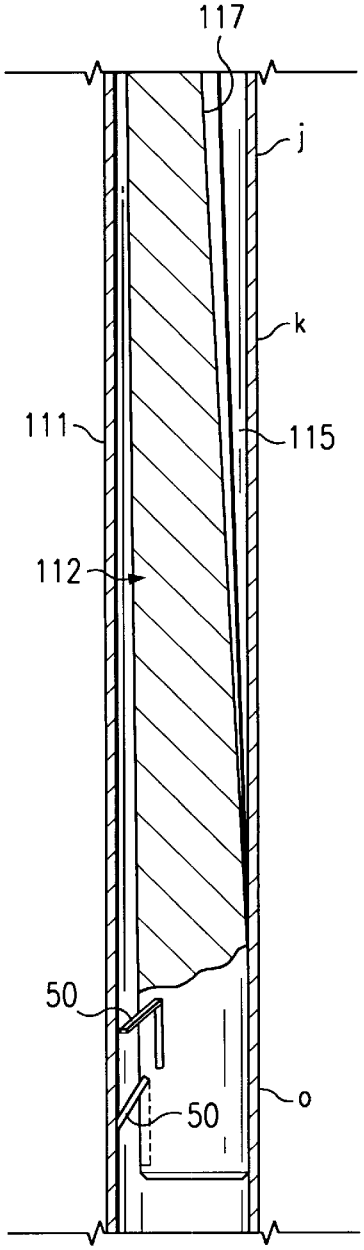
FIG. 4A is an elevational view of the lower portion of the embodiment of FIG. 3A.
Figure 4B:
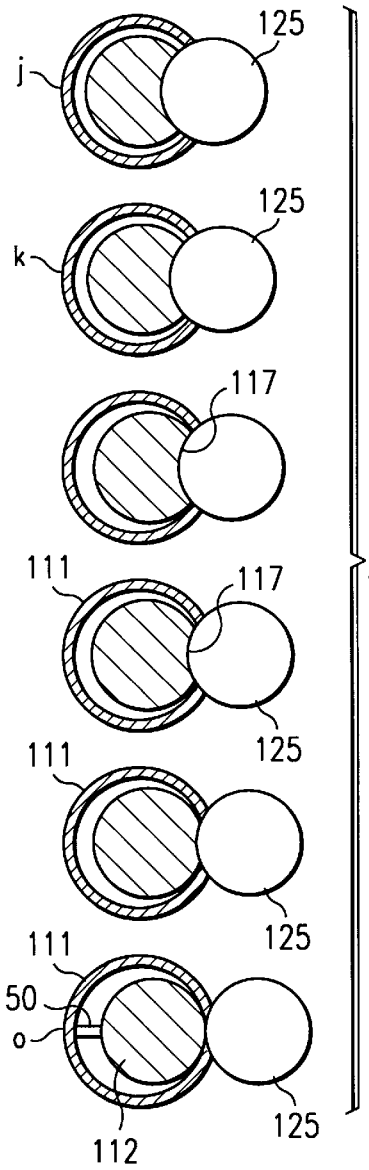
FIG. 4B is further cross-sectional views which correspond to respective levels (only a few numbered for brevity) of the whipstock and wellbore of FIG. 4A.

Referring now to FIGS. 3A thru 4B, a further embodiment of the present invention is illustrated which is especially adapted to be run and operated through a tubular string (e.g. production tubing string 30 or the like) which is present within casing 111 of cased wellbore 110. Whipstock 112 is similar to whipstock 12 in that it is comprised of an elongated body 114 which is substantially cylindrical at its lower lower end and is tapered along a portion 115 (i.e. tapered portion 115) of its length towards its upper end 116. The surface 117 (i.e. concaved surface 117) of tapered portion 115 may be increasingly concaved from the top to the bottom thereof as best seen in FIGS. 3B and 4B. In order for the whipstock 112 to be run and operated through tubing string 30, the "envelope" or maximum diameter (i.e. that at the bottom of the whipstock) must be slightly less than the inner diameter of tubing 30.

Guide 120 is spaced from and is mounted to tapered portion 115. As shown, guide 120 is a length of conduit (i.e. metal pipe) which is attached to and spaced from tapered portion 115 by one or more supports 121 (see FIG. 3B) Preferably, the upper end of guide 120 is flared to form a funnel-like entrance 122 or the like while a portion of the otherwise cylindrical guide 120 (i.e. the front wall of the cylinder) is removed along approximately the lower half of its length. This is necessary to keep the overall diameter of the whipstock within the envelope required for lowering the whipstock through the tubing string 30. Again, while guide

120 is shown basically as a cylindrical pipe with only a portion of its length being cut away, it should be understood that none of its length has to be an enclosed cylinder and could be open along the entire front of its length if desired; guide 120 may be a "trough". That is, the guide need only to be capable of receiving and "guiding" the nose 127 of mill 125 along the assigned path while maintaining the mill away from concaved surface 117 of the whipstock.

In operation, whipstock 112 is releasably mounted and lowered on a workstring (e.g. coiled tubing string, not shown). The workstring can be a separate setting string or, in some instances, may be the string which carries a downhole motor (not shown) and mill 125 (dotted lines in FIG. 3A). In either case, the workstring is normally connected to whipstock 112 by a releasable connection (e.g. shear pin) so that the workstring can be released after the whipstock is orientated and set.

Again, whipstock 112 can be oriented and set in position by conventional means, e.g. set onto an expandable packer/anchor (not shown) which is lowered through tubing 30 and then expanded by a standard setting tool or, as illustrated, the whipstock can be lowered on a workstring which can be manipulated to deploy legs 50 which are retracted into the body of the whipstock as it passes through tubing 30. Legs 50, when properly orientated, engage casing 111 to force the lower of the whipstock towards one side of the casing and hold the whipstock in a desired oriented position. For a complete description of such a setting mechanism for a whipstock, see U.S. Pat. No. 5,222,554, issued Jun. 29, 1993, and which is incorporated herein by reference.

Mill 125 (FIG. 3A) is basically the same as described above in that it has a pilot or nose portion 127 depending from the bottom thereof. Mill 125 has cutting surfaces both on its bottom 125*a* and its side 125*b*. As drill string 26 is lowered into casing 111, nose portion 127 of the mill 125 engages funnel 122 which, in turn, directs the nose portion 127 into guide 120. The cooperation between nose portion 127 and guide 120 directs mill 125 into contact with casing 111 while preventing the mill from contacting tapered surface 115 on whipstock 112.

As mill 125 is rotated by a downhole motor (not shown), the cutting surfaces on the side 125*b* of the mill will begin to cut a window $W_1$ (FIGS. 3B and 4B) in casing 111 while the cutting surface on the bottom 125*a* will mill away the guide 120, itself, and supports 121. The individual cross-sectional views shown in FIG. 3A and 3B illustrate the instantaneous relationship of (a) the concaved surface 117 on the whipstock 112, (b) mill 125, (c) guide 120; and (d) window $W_1$ in casing 111 at respective levels a, b, c, etc. along the length of the whipstock. Only some of these levels and elements are labelled for the sake of clarity. Again, through the use of guide 120, the mill is forced and maintained into cutting contact with the casing and away from inclined or tapered surface 115 of whipstock 112 and a longer window $W_1$ can be cut with the initially used mill 112.

What is claimed is:

1. A whipstock for use in milling a window in a well tubular, said whipstock comprising:

an elongated body having a tapered surface along at least a portion of its length;

a guide mounted on and spaced from said tapered surface; said guide adapted to receive a mill and direct said mill away from said tapered surface as said mill moves along said whipstock wherein said guide comprises:

an elongated guide member positioned to lie substantially parallel to said tapered surface.

2. The whipstock of claim 1 wherein said guide member comprises:

an elongated cylindrical member adapted to receive a nose portion of said mill.

3. The whipstock of claim 2 wherein said cylindrical member comprises:

a length of pipe.

4. The whipstock of claim 2 wherein said cylindrical member includes a flared upper end to receive a nose portion of said mill and direct it into said cylindrical member.

5. The whipstock of claim 1 wherein said guide member comprises:

an elongated cylindrical member having a cylinder wall wherein at least a portion of the cylinder wall is removed along at least a portion of its length.

6. The whipstock of claim 5 wherein said cylindrical member includes a flared upper end to receive a nose portion of said mill and direct it into said cylindrical member.

7. Apparatus for milling a window in the casing of a cased, subterranean wellbore, said apparatus comprising:

a whipstock comprising:

an elongated body having a tapered surface along at least a portion of its length; and a guide mounted on and spaced from said tapered surface wherein said guide comprises:

an elongated guide member positioned to lie substantially parallel to said tapered surface; and a mill having cutting surfaces on both its bottom and its side, said mill having a nose portion depending from the bottom thereof which is adapted to be received by said guide.

8. The whipstock of claim 7 wherein said guide member comprises:

an elongated cylindrical member adapted to receive said nose portion of said mill.

9. The whipstock of claim 8 wherein said cylindrical member comprises:

a length of pipe.

10. The whipstock of claim 8 wherein said cylindrical member includes a flared upper end to receive said nose portion of said mill and direct it into said cylindrical member.

11. The whipstock of claim 7 wherein said guide member comprises:

an elongated cylindrical member having a cylinder wall wherein at least a portion of the cylinder wall is removed along at least a portion of its length.

12. The whipstock of claim 11 wherein said cylindrical member includes a flared upper end to receive said nose portion of said mill and direct it into said cylindrical member.

13. The whipstock of claim 7 wherein said cased wellbore includes a string of tubing therein and wherein said whipstock and said mill are sized to be lowered through said string of tubing.

* * * * *